US006712145B2

(12) United States Patent
Allamon

(10) Patent No.: US 6,712,145 B2
(45) Date of Patent: Mar. 30, 2004

(54) FLOAT COLLAR

(75) Inventor: Jerry P. Allamon, Montgomery, TX (US)

(73) Assignee: Allamon Interests, Montgomery, TX (US)

( * ) Notice: Subject to any disclaimer, the term of this patent is extended or adjusted under 35 U.S.C. 154(b) by 36 days.

(21) Appl. No.: 10/073,777

(22) Filed: Feb. 11, 2002

(65) Prior Publication Data

US 2003/0047315 A1 Mar. 13, 2003

Related U.S. Application Data

(63) Continuation-in-part of application No. 09/951,828, filed on Sep. 11, 2001.

(51) Int. Cl.[7] ..... E21B 17/14

(52) U.S. Cl. ..... 166/327; 166/332.8

(58) Field of Search ..... 166/242.8, 154, 166/156, 194, 222, 327, 328, 334.4, 332.8, 386

(56) References Cited

U.S. PATENT DOCUMENTS 3,645,495 A * 2/1972 Aymar ..... 251/129
3,995,692 A * 12/1976 Seitz ..... 166/318
4,469,174 A * 9/1984 Freeman ..... 166/202
4,615,394 A * 10/1986 Kuhlman, Jr. ..... 166/327
4,729,432 A * 3/1988 Helms ..... 166/317
5,246,069 A * 9/1993 Glaser et al. ..... 166/156
6,209,663 B1 * 4/2001 Hosie ..... 175/57
6,244,342 B1 * 6/2001 Sullaway et al. ..... 166/285
6,401,824 B1 * 6/2002 Musselwhite et al. ..... 166/327

* cited by examiner

*Primary Examiner*—Frank Tsay
(74) *Attorney, Agent, or Firm*—O'Neil & McConnell, PLLC; R. Perry McConnell

(57) ABSTRACT

The present invention relates to a float collar apparatus for regulating the passage of fluid through a drilling/production liner or sub-sea casing. Apparatus of the present invention is fabricated using plastic flapper valves and valve-actuating sleeve components in contrast to prior art float collar components which are fabricated almost entirely of hard metals. Particularly, the plastic may be nylon, phenolic, or a phenolic-nylon laminate. The use of plastic components in the float collar apparatus of the present invention provides a substantial reduction in time and resources expended during drilling out of the float collar once cementing operations are completed. Additionally, the float collar apparatus of the present invention is fabricated from a pre-determined combination of plastic components and metal components thereby ensuring that the improved float collar can still endure substantial hydrostatic stresses encountered during casing liner running in and cementing operations.

44 Claims, 7 Drawing Sheets

FLOAT COLLAR

CROSS-REFERENCE TO RELATED APPLICATIONS

This application is a continuation-in-part of U.S. application Ser. No. 09/951,828 filed on Sep. 11, 2001.

BACKGROUND OF THE INVENTION

1. Field of the Invention

The present invention relates to apparatus for use in the oil industry, and, more particularly, to a float collar apparatus for use in oil well drilling operations.

2. Description of the Prior Art

Float collars are utilized by the oil well industry with respect to operations for running in and cementing casing liners down a wellbore. An example of a prior art float collar is the Multi-Purpose Float Collar manufactured and sold by Davis-Lynch, Inc. The Multi-Purpose Float Collar comprises a tubular housing having a bore therethrough and two spring-activated flapper valves which are held in an open position by a sliding sleeve installed in the bore of the float collar. Once the sleeve is forced out of the bore of the float collar, the spring-activated flapper valves are free to rotate to their closed positions.

In practice, a float collar, such as the Multi-Purpose Float Collar of Davis-Lynch, Inc., is installed within the lower end of a casing liner prior to running the casing liner down a wellbore. When the spring-activated flapper valves of the float collar are held in an open position by the sliding sleeve, a clear passage is provided through the casing liner. This open position permits drilling fluid to flow freely through the float collar as the casing liner is being run downhole, which helps to reduce surge pressure against the borehole walls and permits the casing liner to be more readily lowered to total depth. Additionally, if a tight hole condition is encountered during running in of the casing liner, drilling fluid can be pumped downward through the casing liner to circulate drilling fluid around the tight hole condition thereby freeing the casing liner.

Once the casing liner is lowered to total depth, the sliding sleeve of the float collar is actuated using a drop ball, which seats in a ball seat which is coupled to the sliding sleeve. The sliding sleeve is held in place by shear pins installed in the lower portion of the sleeve. Pressure is then increased above the drop ball until the shear pins shear, at which time the sleeve is displaced axially out of the float collar. This movement of the sleeve frees the spring-activated flapper valves to rotate to a closed position. In the closed position, the flow path through the casing liner is obstructed such that any fluid passing through the casing liner must overcome the resistance of the spring-activated flapper valves to establish communication between the lower end of the casing liner and the annulus between the casing liner and the borehole.

During cementing operations, cement is pumped downward through the casing liner at sufficiently high pressure to overcome the resistance of the spring-activated flapper valves. Once cement pumping operations cease, the spring-activated flapper valves close and seal the passage through the casing liner. This prevents the cement from flowing back upward into the casing liner. This effect is also known in the art as "back-flow" or "u-tube" action. Finally, once cementing operations are completed, the entire float collar assembly is drilled out of the casing liner to reestablish an unobstructed flow path through the wellbore.

While prior art float collars have produced desirable results for the oil well industry, an undesirable feature of prior art float collars is that once cementing operations are complete, prior art float collars require approximately six hours to drill out of the casing liner to reestablish the unobstructed flow path. This relatively long drill out time is due in large part to the high metal content of components of the float collar. Prior art float collars are fabricated almost entirely of metals, e.g. aluminum. While the use of such metals allows the float collar assembly to be set at pressures up to 3000 psi, the metal components of the float collar assembly become a disadvantage when cementing operations are completed and valuable time and resources must be expended during drilling out the float collar.

Accordingly, it would be desirable to have a float collar which can be drilled out in substantially less time than prior art float collars. This novel and useful result has been achieved by the present invention.

SUMMARY OF THE INVENTION

Apparatus in accordance with the present invention comprises a float collar assembly for regulating the passage of fluid through a tubular member, such as a casing liner. The float collar assembly is positioned within the tubular member cased in cement at the lower end of the tubular member.

In a first embodiment of the present invention, a float collar assembly comprises an outer housing having an axial bore therethrough and one or more spring-activated flapper valves arranged within the housing. The spring-activated flapper valves are activated by an internal valve-actuating sleeve which is fabricated from a hardened plastic material. Such hardened plastic material may include a modified nylon blend material, such as cast type 6 nylon having enhanced thermal-resistant, weather-resistant, and bearing properties, or a nylon-phenolic laminate. The actuating sleeve is initially held inside the housing by a connecting means. While the actuating sleeve is connected to the housing, the spring-activated flapper valves are secured by the actuating sleeve in an open position. A drop ball seat is integral with the actuating sleeve and is located at the bottom of the actuating sleeve. The seat receives a drop ball thereby creating a seal which blocks fluid flow through the tubular member. Subsequently, fluid pressure is increased above the drop ball seat to activate the connecting means to release the actuating sleeve and displace the actuating sleeve downward from the housing. Once the actuating sleeve is displaced from the housing, the spring-activated flapper valves are free to rotate to a closed position. In the closed position, the spring-activated flapper valves obstruct passage through the tubular member.

In another embodiment of the present invention, the connecting means is a set of shear pins which connect the actuating sleeve to the housing. When the connecting means is activated by the drop ball, the set of shear pins is sheared. Once the set of shear pins is sheared, the actuating sleeve is free to displace axially downward out of the housing.

In still another embodiment of the present invention, the connecting means is a shoulder formed on the upper end of the actuating sleeve which protrudes radially outward and a groove formed in the axial bore of the housing. Initially, the shoulder of the actuating sleeve engages the groove of the housing to connect the actuating sleeve to the housing. When the connecting means is activated, the shoulder of the actuating sleeve is sheared by the groove of the housing. Once the shoulder is sheared, the actuating sleeve is free to displace axially downward out of the housing.

In yet another embodiment of the present invention, the connecting means is a lightweight metal shearing sleeve attached to the upper end of the actuating sleeve having a shoulder formed on the upper end of the shearing sleeve which protrudes radially outward and a groove formed in the axial bore of the housing. The shoulder of the shearing sleeve engages the groove of the housing to connect the actuating sleeve to the housing. The connecting means also includes a recess formed between the upper end and lower end of the shearing sleeve such that thickness of the wall of the shearing sleeve is smallest at the recess. When the connecting means is activated, the shearing sleeve is sheared at the recess at a predetermined pressure. Once the shearing sleeve is sheared, the actuating sleeve is free to displace axially downward out of the housing.

Furthermore, while components of prior art float collars are fabricated almost entirely from metal, the float collar apparatus of the present invention is fabricated from a combination of metal and non-metal components, or from non-metal components only. This resultant float collar assembly provides a savings in time and resources expended during drilling out of the float collar.

DETAILED DESCRIPTION OF SPECIFIC EMBODIMENTS

A description of certain embodiments of the present invention is provided to facilitate an understanding of the invention. This description is intended to be illustrative and not limiting of the present invention. The preferred embodiment of the float collar of the present invention will be described with respect to installation of an oil well casing liner. The term "casing liner" is referred to throughout this application and is intended to mean a "drilling/production liner" or a "sub-sea casing." However, it is intended that the present invention may be utilized with any tubular member being run in and cemented in a wellbore.

Figure 1:
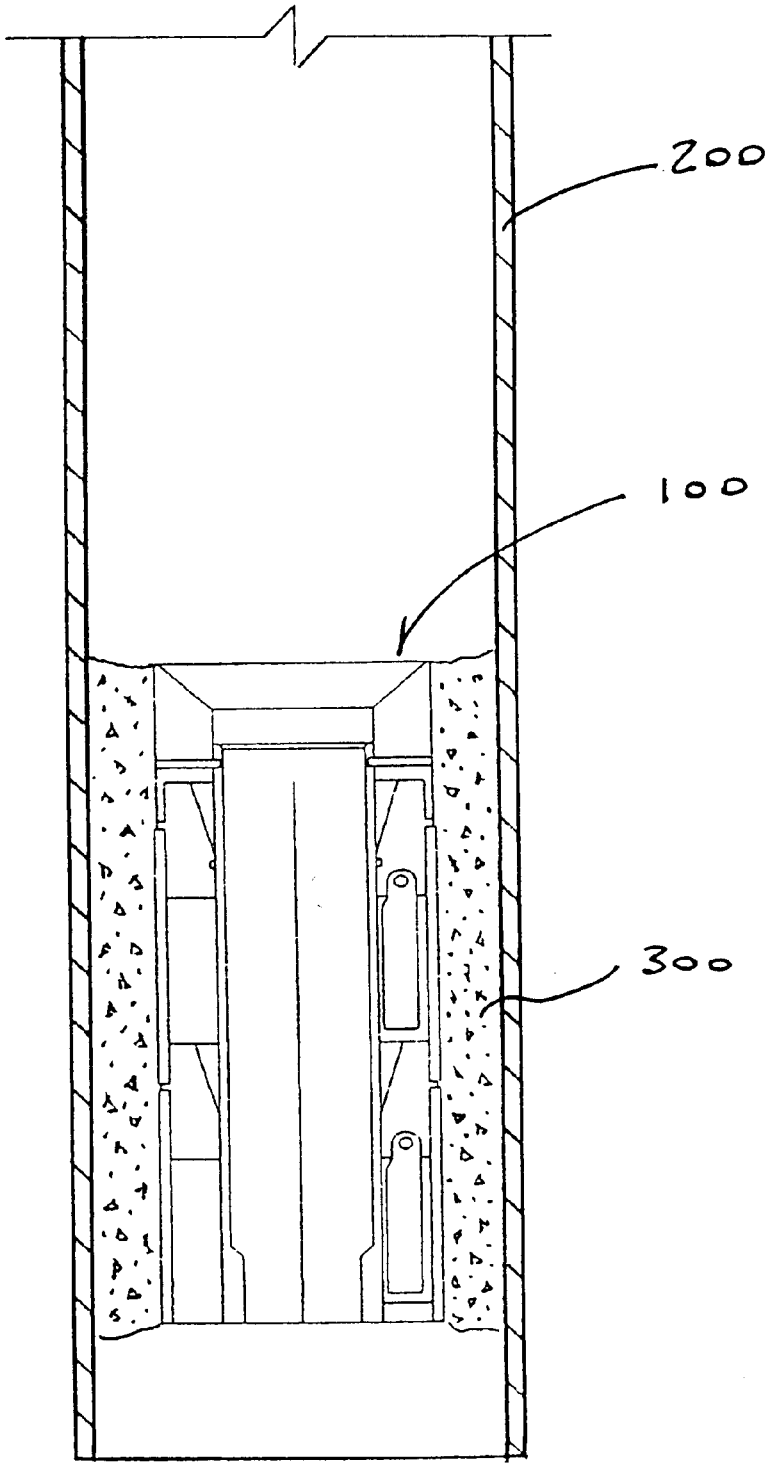
FIG. 1 is a profile view of a float collar in accordance with the present invention for regulating the position of spring-activated flapper valves in an oil well casing liner.

With reference to FIG. 1, an apparatus in accordance with the present invention includes a float collar assembly 100 held in place by cement 300 at the lower end of tubular member 200.

Figure 3:
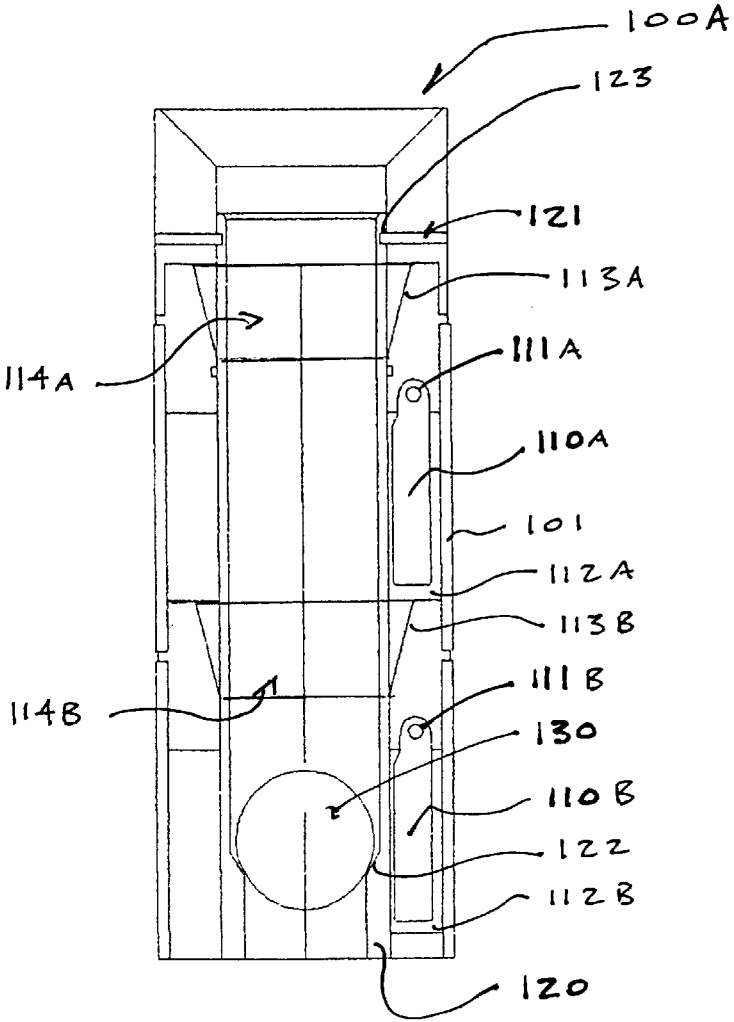
FIG. 3 is an enlarged section view of a first embodiment of a float collar in accordance with the present invention with drop ball lodged in seat of actuating sleeve.
Figure 2:
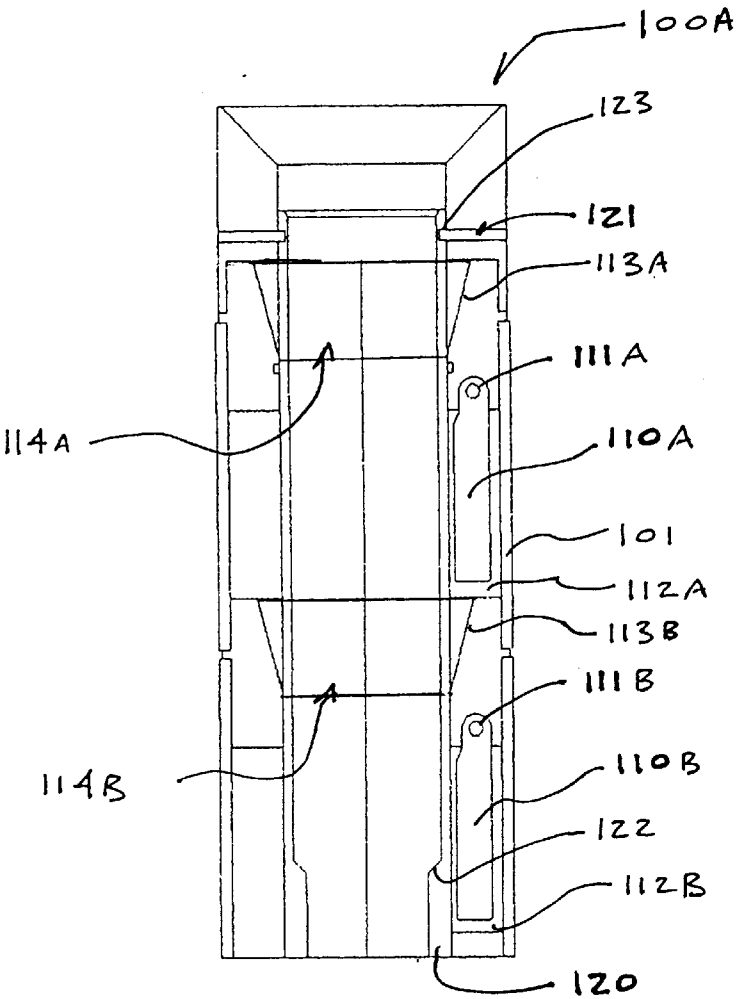
FIG. 2 is an enlarged section view of a first embodiment of a float collar in accordance with the present invention with actuating sleeve in place securing spring-activated flapper valves in an open position.

With reference to FIG. 2, a first embodiment of a float collar assembly 100A in accordance with the present invention includes a housing 101, two flapper valve assemblies 114A, 114B, and a valve-actuating sleeve 120. Each flapper valve assembly 114A, 114B includes a flapper 110A, 110B, a flapper recess 112A, 112B, a pin and spring 111A, 111B, and a frustoconical valve body 113A, 113B. The actuating sleeve 120 includes a drop ball seat 122 integral with the inner surface of the actuating sleeve and having an axial bore therethrough for receiving a drop ball 130 (FIG. 3). The diameter of the drop ball 130 (FIG. 3) is less than or equal to diameter of the actuating sleeve 120, but greater than diameter of the axial bore of the drop ball seat 122. Additionally, the actuating sleeve 120 includes a plurality of pin recesses 123 for receiving a plurality of shear pins 121. The pin recesses 123 are formed along the outer surface and near the upper end of the actuating sleeve 120.

Still with reference to FIG. 2, in operation, the first embodiment of a float collar apparatus in accordance with the present invention is installed within the lower end of a casing liner 200 (FIG. 1) with the actuating sleeve 120 holding the flappers 110A, 110B of the flapper valve assemblies 114A, 114B in an open position against the tension of the flapper springs 111A, 111B. The actuating sleeve 120 is restrained from axial displacement by the shear pins 121 installed in the pin recesses 123 of the actuating sleeve. An open flow path exists through the float collar and the drilling fluid can pass unobstructed through the axial bore of housing 101.

With reference to FIG. 3, once the casing liner 200 (FIG. 1) is lowered to total depth, a drop ball 130 is dropped down the casing liner, through the upper end of the housing 101, and into the drop ball seat 122. The drop ball 130 seals with the drop ball seat 122 thereby obstructing the flow path of drilling fluid through the casing liner 200 (FIG. 1).

Figure 4:
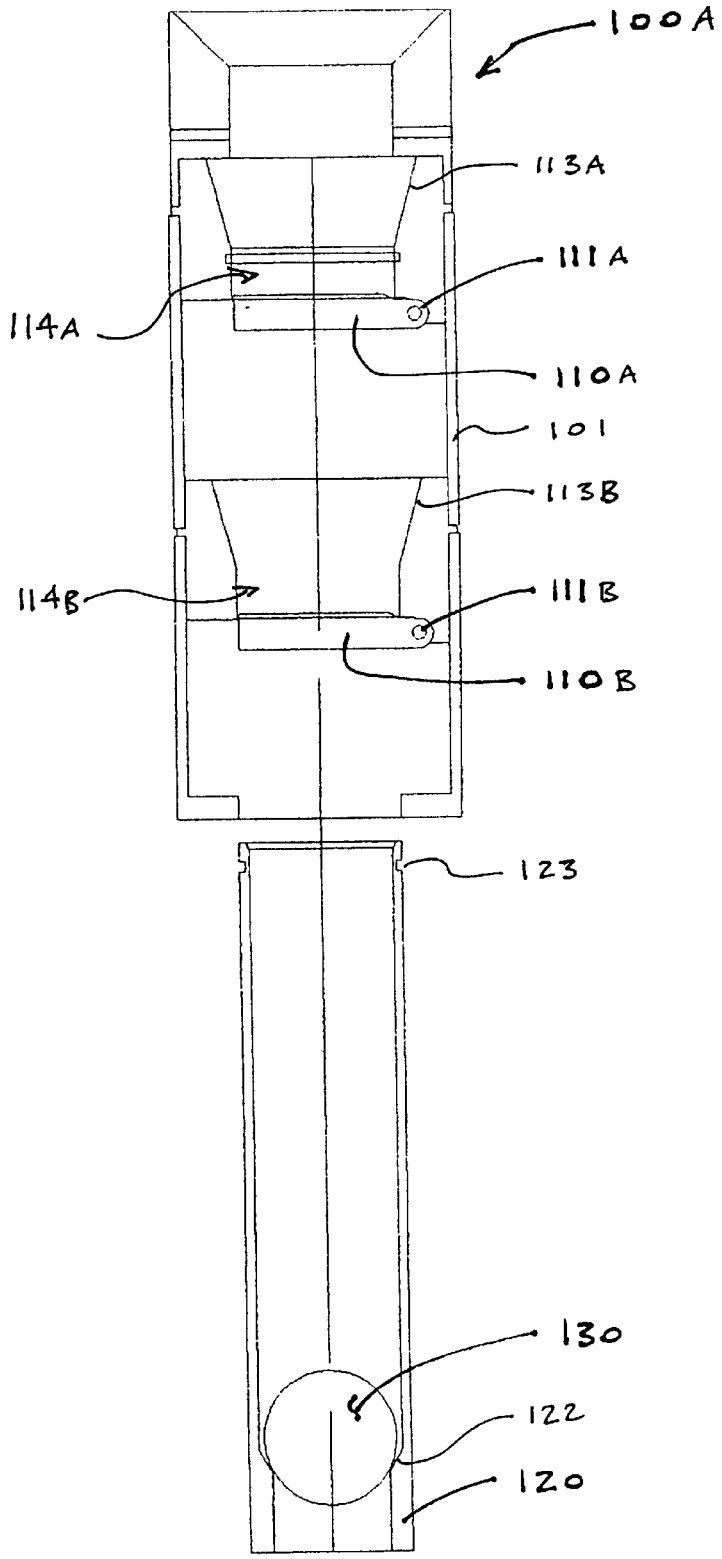
FIG. 4 is an enlarged section view of a first embodiment of a float collar in accordance with the present invention with actuating sleeve displaced downward from float collar housing and spring-activated flapper valves rotated to closed position.

Next, with reference to FIG. 4, drilling fluid pressure is increased above the drop ball 130 and the drop ball seat 122 to a predetermined level such that the shear pins 121 shear. With the shear pins 121 sheared, the actuating sleeve 120 is free to displace axially downward out of the housing 101 to the bottom of the borehole. Once the actuating sleeve 120 is displaced from the housing 101, the flappers 110A, 110B of the flapper valve assemblies 114A, 114B are forced by the springs 111A, 111B to rotate into engagement with the frustoconical valve bodies 113A, 113B. In this position, cementing operations may be commenced.

During cementing of the casing liner 200 (FIG. 1) to the borehole, cement is pumped downward through the casing liner, out of the axial bore of housing 101, and upward into the annulus between the borehole and the casing liner. To pass the closed flappers 110A, 110B of flapper valve assemblies 114A, 114B, the hydrostatic pressure of the cement is increased to overcome the resistance of the springs 111A, 111B of the flappers. Once the predetermined quantity of cement is deployed and the hydrostatic pressure is reduced, the springs 111A, 111B of the flapper valve assemblies 114A, 114B force the flappers 110A, 110B upwards to engage the frustoconical valve bodies 113A, 113B. This once again obstructs the flow path through the housing 101 and prevents the cement from traveling back into the casing liner 200 (FIG. 1).

Finally, once cementing operations are completed, the components of float collar assembly 100A are drilled out to provide an open flow path to the bottom of the borehole.

Figure 5:
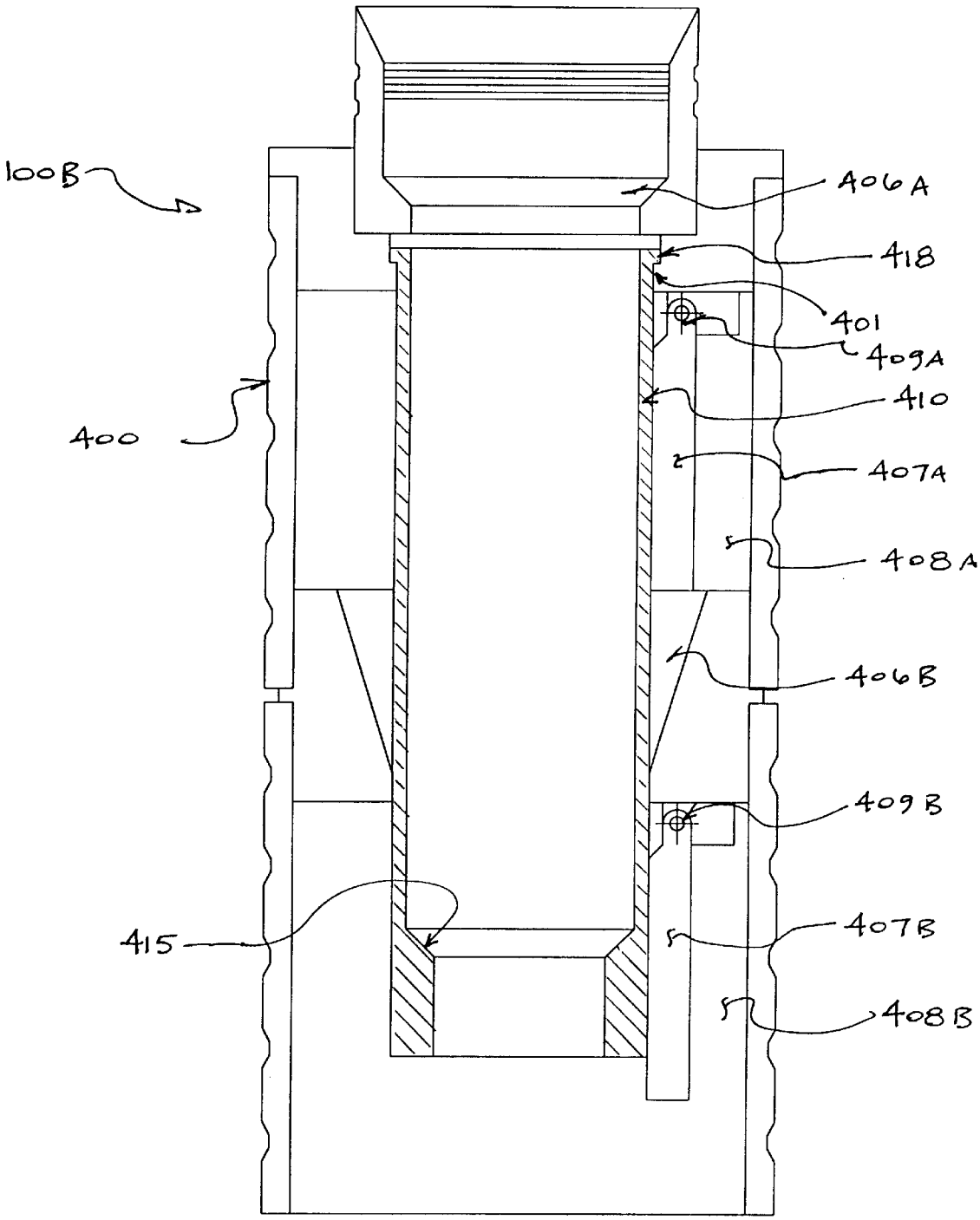
FIG. 5 is an enlarged section view of a second embodiment of a float collar in accordance with the present invention with actuating sleeve in place securing spring-activated flapper valves in an open position.
Figure 6C:
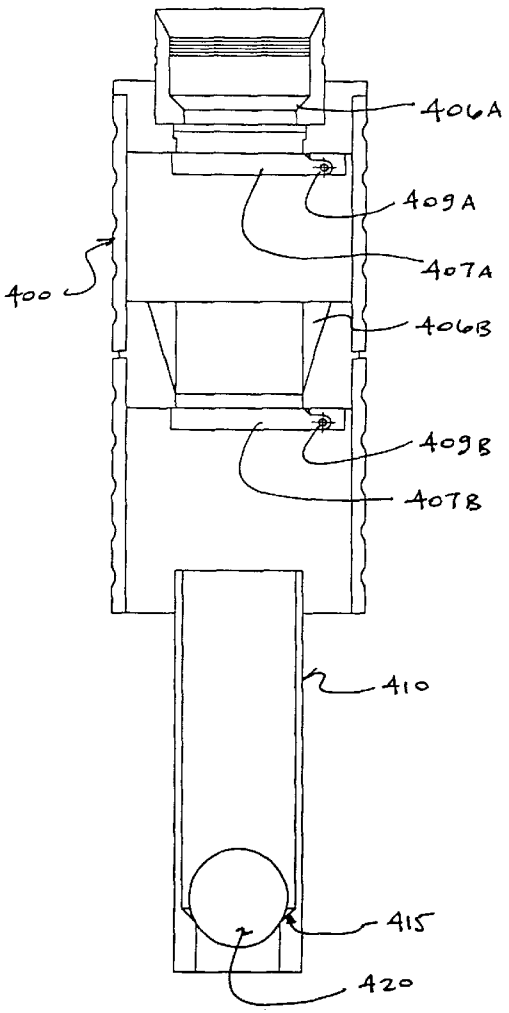
FIG. 6C is an enlarged section view of a second embodiment of a float collar in accordance with the present invention with actuating sleeve displaced completely downward from float collar housing and spring-activated flapper valves rotated to closed position.
Figure 6B:
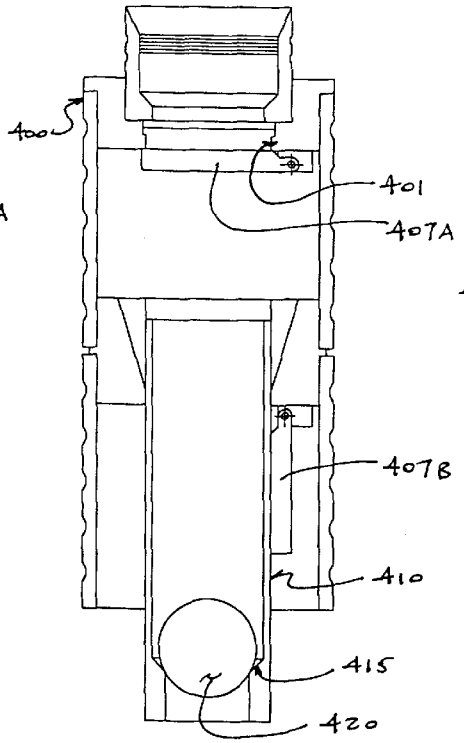
FIG. 6B is an enlarged section view of a second embodiment of a float collar in accordance with the present invention with actuating sleeve being displaced axially downward.
Figure 6A:
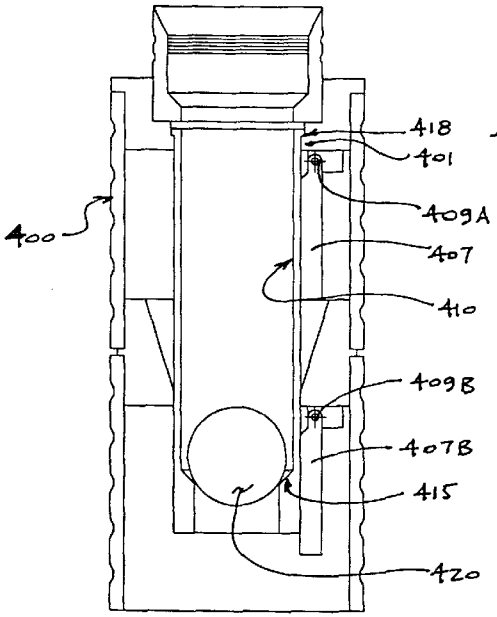
FIG. 6A is an enlarged section view of a second embodiment of a float collar in accordance with the present invention with a drop ball seated in drop ball seat of actuating sleeve.

With reference to FIG. 5, a second embodiment of a float collar assembly 100B in accordance with the present invention comprises a housing 400, two flapper valve assemblies, and a valve-actuating sleeve 410. Each flapper valve assembly comprises a flapper 407A, 407B, a flapper recess 408A, 408B, a pin and spring 409A, 409B, and a frustoconical valve body 406A, 406B. The actuating sleeve 410 comprises a drop ball seat 415 being integral with the inner surface of the actuating sleeve and having an axial bore therethrough for receiving a drop ball 420 (FIGS. 6A–6C). The diameter of the drop ball 420 (FIGS. 6A–6C) is less than or equal to diameter of the actuating sleeve 410, but greater than diameter of the axial bore of the drop ball seat 415. Additionally, the actuating sleeve 420 comprises a shoulder 418 protruding radially outward for engaging with a groove 401 formed in the housing 400 and protruding radially inward. The shoulder 418 is formed near the upper end of the actuating sleeve 420.

With reference to FIGS. 6A–6C, in operation, the second embodiment of a float collar apparatus of the present invention is installed within the lower end of a casing liner 200 (FIG. 1) with the actuating sleeve 410 holding the flappers 407A, 407B of the flapper valve assemblies in an open position against the tension of the flapper springs 409A, 409B. The actuating sleeve 410 is restrained from axial displacement by the protruding shoulder 418 of the actuating sleeve and the groove 401 of the housing 400. This creates an open flow path through which drilling fluid can pass unobstructed through the axial bore of housing 400.

With reference to FIG. 6A, once the casing liner 200 (FIG. 1) is lowered to total depth, a drop ball 420 is dropped down the casing liner, through the upper end of the housing 400, and into the drop ball seat 415. The drop ball 420 seals with the drop ball seat 415 thereby obstructing the flow path of drilling fluid through the casing liner 200 (FIG. 1).

Next, with reference to FIG. 6B, drilling fluid pressure is increased above the drop ball 420 and the drop ball seat 415 to a predetermined level such that the shoulder 418 (FIG. 6A) of the actuating sleeve 410 is sheared by the groove 401 of the housing 400. With the shoulder 418 (FIG. 6A) sheared, the actuating sleeve 410 is free to displace axially downward out of the housing 400 to the bottom of the borehole.

With reference to FIG. 6C, once the actuating sleeve 410 is displaced from the housing 400, the flappers 407A, 407B of the flapper valve assemblies are forced by the springs 409A, 409B to rotate into engagement with the frustoconical valve bodies 406A, 406B. In this position, cementing operations may be commenced following the same steps as in the first embodiment.

Figure 7B:
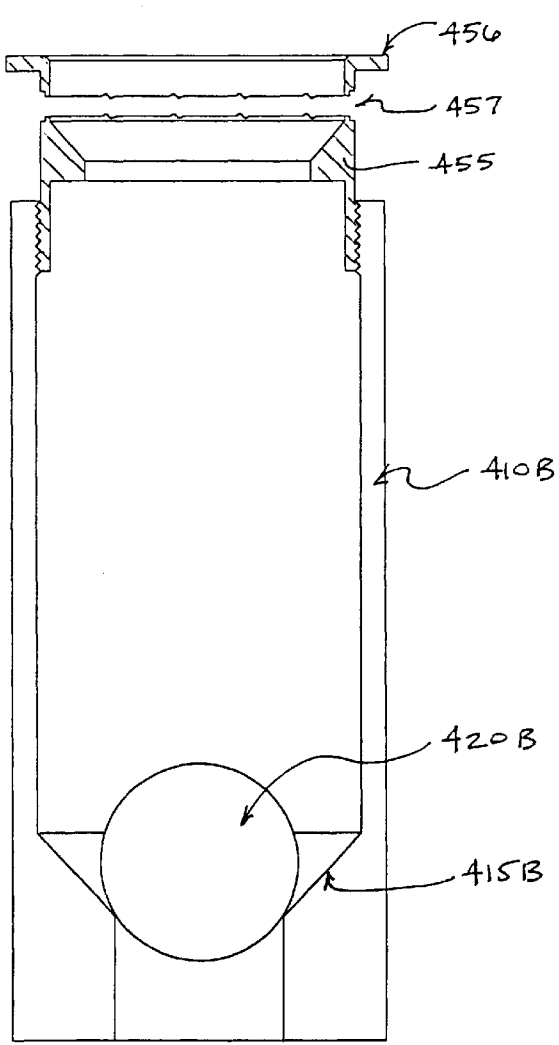
FIG. 7B is an elevation view of the actuating sleeve of FIG. 7A with a drop ball seated in drop ball seat of actuating sleeve and depicting the aluminum shearing sleeve being sheared.
Figure 7A:
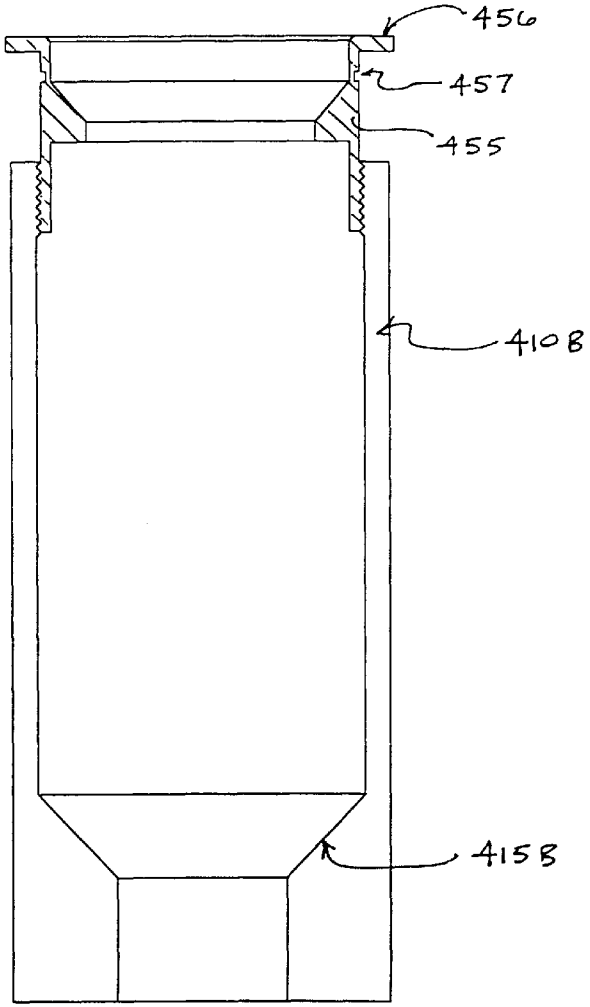
FIG. 7A is an elevation view of an embodiment of the actuating sleeve being fabricated from a phenolic-nylon laminate and having an aluminum shearing sleeve attached to the top.

With reference to FIG. 7A, an alternative valve-actuating sleeve 410B of the second embodiment of the float collar assembly comprises a drop ball seat 415B integral with the actuating sleeve and a shearing sleeve 455 attached to the upper end of the actuating sleeve 410B. The shearing sleeve 455 is fabricated from a lightweight metal, preferably aluminum. The shearing sleeve 455 is preferably in threaded connection with upper end of the actuating sleeve 410B, but it is intended that any secure connecting means known in the art may be employed.

Still with reference to FIG. 7A, the shearing sleeve 455 comprises a shoulder 456 protruding radially outward for engaging with the groove 401 in the housing 400 of the float collar assembly 100B (FIG. 5). The shoulder 456B is formed near the upper end of the shearing sleeve 455. A shearing recess 457 is formed between the upper end and lower end of the shearing sleeve 455. The shearing recess 457 is formed such that the thickness of the wall of the shearing sleeve 455 is smallest at the recess.

With reference to FIG. 7B, to displace the actuating sleeve 410B from the housing 400 (FIG. 5), a drop ball 420B is landed in the drop ball seat 415B. The drop ball 420B seals with the drop ball seat 415B thereby obstructing the flow path of drilling fluid through the casing liner 200 (FIG. 1). Next, drilling fluid pressure is increased above the drop ball 420B and the drop ball seat 415B to a predetermined level such that the shearing sleeve 455 is sheared at the shearing recess 457. With the shearing sleeve 455 sheared, the actuating sleeve 410B is free to displace axially downward out of the housing 400 (FIG. 5) to the bottom of the borehole.

Each of the embodiments of the present invention comprises components fabricated from materials such that the float collar assembly can endure high stresses typical of a running in and cementing operation, but can also be drilled out of the casing liner in a shorter period of time than that of prior art float collars. Accordingly, the flapper valve assemblies and the actuating sleeve and seat of each embodiment are fabricated from a hardened plastic material. However, the housing is fabricated from a lightweight metal or other hardened material having bearing and wear characteristics that are sufficient to endure high stresses involved in running in and cementing operations.

In a particular embodiment of the present invention, the hardened plastic material is a modified nylon blend material, such as Vekton 6XAU, manufactured by Ensinger, Inc. Vektron 6XAU is a cast type 6 nylon having enhanced heat-resistant, weather-resistant, and bearing properties.

Figure 8A:
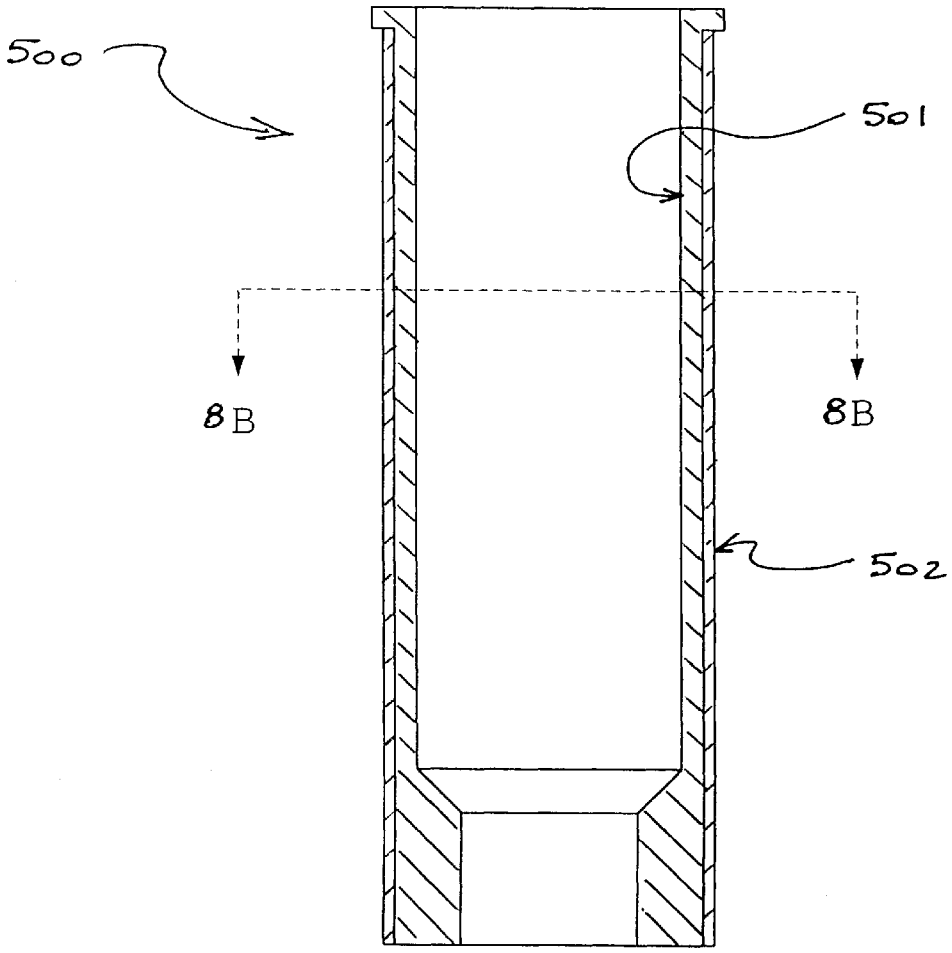
FIG. 8A is an elevation view of an embodiment of the actuating sleeve being fabricated from a phenolic-nylon laminate.
Figure 8B:
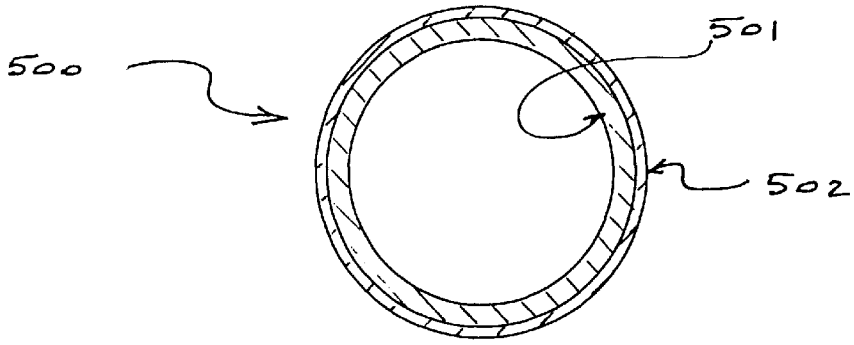
FIG. 8B is a sectional view of the actuating sleeve of FIG. 8A depicting each layer of the phenolic-nylon laminate.

In another embodiment of the present invention, the valve-actuating sleeve is fabricated from a phenolic-nylon laminate. With respect to FIGS. 8A and 8B, the valve-actuating sleeve 500 has an outer phenolic layer 501 and an inner nylon layer 502. The phenolic layer 501 provides enhanced tensile strength properties, while the nylon layer 502 reinforces the phenolic layer to enable the actuating sleeve 500 to resist high impact loads. Furthermore, in accordance with this embodiment of the present invention, the flapper valve assemblies are fabricated from a phenolic material.

While preferred embodiments of the present invention comprise components which are fabricated from a nylon material, a phenolic material, or a phenolic-nylon laminate, it is intended that these components may be fabricated from any plastic-material having thermal-resistant, bearing, and fatigue characteristics that are sufficient to endure high stresses involved in running in and cementing operations, but that will yield at a lower stress than metal components during drill out operations.

While prior art full metal float collars typically require about six hours to drill out, the non-metal components of the float collar of the present invention are more yielding to drill out operations and are expected to reduce drill out time substantially. However, the float collar assembly of the present invention can still withstand a maximum stress of approximately 600 psi.

As used in the appended claims, the term "connecting means" is intended to cover a shear pin, shearing shoulder, or shearing sleeve as described herein, and all equivalents of such structures.

Furthermore, as used in the appended claims, the term "hardened material" is intended to mean lightweight metal, such as aluminum, or a hardened plastic material having bearing and wear characteristics that are sufficient to endure high stresses involved in running in and cementing operations, such as phenolic, and all equivalents of such structures.

Still furthermore, as used in the appended claims, the term "hardened plastic material" is intended to mean nylon material, phenolic material, phenolic-nylon laminate, or another plastic material having thermal-resistant, bearing, and fatigue characteristics that are sufficient to endure high stresses involved in running in and cementing operations, but that will yield at a lower stress than metal components during drill out operations, and all equivalents of such structures.

What is claimed is:

1. Float collar apparatus for regulating drilling fluid and cement flow through a tubular member being run in and cemented to a wellbore comprising:

a tubular housing having an external diameter less than the internal diameter of the tubular member and having axial bore therethrough, said housing being fabricated from hardened material, at least one flapper valve arranged within the housing having an open position where communication through the axial bore of the housing is uninterrupted by the flapper valve and a closed position where communication through the housing is interrupted by the flapper valve, said at least one flapper valve being fabricated from hardened plastic material, and a valve-actuating sleeve having an upper end and a lower end and being fabricated from hardened plastic material, said valve-actuating sleeve comprising: (i) an outer surface having a diameter less than or equal to the diameter of the axial bore of the housing; (ii) an inner surface having a seat integrally formed thereon, said seat having an axial bore therethrough with a diameter less than the diameter of the inner surface of the valve-actuating sleeve; and (iii) connecting means for attaching the valve-actuating sleeve to the housing, wherein said hardened plastic materials of said flapper valve and said valve-actuating sleeve can withstand operational conditions within a wellbore for the duration of run in and cementing operations.

2. The apparatus of claim 1, wherein the connecting means for attaching the valve-actuating sleeve to the housing is one or more shearable pins, each of said pins extending into a pin recess formed into the outer surface and near the upper end of the valve-actuating sleeve.

3. The apparatus of claim 1, wherein the connecting means for attaching the valve-actuating sleeve to the housing is a shoulder formed on the upper end of the valve-actuating sleeve and protruding radially outward, and a groove formed in the axial bore of the housing, said shoulder engaging said groove to attach the valve-actuating sleeve to the housing.

4. The apparatus of claim 1, wherein the connecting means for attaching the valve-actuating sleeve to the housing is a groove formed in the axial bore of the housing and a metal shearing sleeve comprising: (i) a lower end being attached to the upper end of the valve-actuating sleeve, (ii) an upper end having a shoulder formed thereon, said shoulder protruding radially outward for engaging the groove of the housing to attach the valve-actuating sleeve to the housing, and (iii) a recess formed between the upper end and lower end of the shearing sleeve such that the thickness of the shearing sleeve is smallest at the recess.

5. The apparatus of claim 4, wherein said metal shearing sleeve is fabricated from aluminum.

6. The apparatus of claim 1, wherein the tubular member is a drilling/production liner or sub-sea casing.

7. The apparatus of claim 1, wherein said hardened material is aluminum.

8. The apparatus of claim 1, wherein said hardened plastic material of said flapper valve comprises a cast nylon.

9. The apparatus of claim 1, wherein said hardened plastic material of said sleeve comprises nylon-phenolic laminate.

10. The apparatus of claim 1, wherein said hardened plastic material of said sleeve comprises a cast nylon.

11. The apparatus of claim 1, wherein said hardened plastic material of said flapper valve comprises a nylon blend.

12. The apparatus of claim 1, wherein said hardened plastic material of said sleeve comprises a nylon blend.

13. The apparatus of claim 1, wherein said hardened plastic material of said flapper valve comprises type 6 nylon.

14. The apparatus of claim 1, wherein said hardened plastic material of said sleeve comprises type 6 nylon.

15. The apparatus of claim 1, wherein said hardened plastic material of said flapper valve comprises phenolic.

16. A system for regulating drilling fluid and cement flow through a tubular member being run in and cemented to a wellbore, said system comprising:

a housing being fixed within the tubular member and positioned near the lower end of the tubular member, said housing being fabricated from hardened material and having an axial bore therethrough to provide a conduit for drilling fluid and cement to flow downward through the tubular member and into the wellbore, at least one plastic flapper valve arranged within the housing and being fabricated from hardened plastic material, said at least one flapper valve having: (i) an open position where drilling fluid can flow through the axial bore of the housing, and (ii) a closed position where cement can flow downward from the tubular member into the wellbore but where cement cannot flow upward from the wellbore into the tubular member, a valve-actuating sleeve arranged within the housing, having an upper end, a lower end, and a drop ball seat integrally formed therein, and being fabricated from hardened plastic material, said valve-actuating sleeve being movable from a fixed position where connecting means prevents the valve-actuating sleeve from sliding axially downward such that the flapper valve is in the closed position, to a displaced position where the valve-actuating sleeve is displaced axially downward out of the housing such that the flapper valve moves to the closed position, a drop ball having a diameter greater than the diameter of the axial bore of the seat of the valve-actuating sleeve but less than or equal to the inner diameter of the valve-actuating sleeve, said drop ball being released into the housing and sealing with the seat, and means for increasing drilling fluid pressure above the drop ball to a predetermined level to move the valve-actuating sleeve from the fixed position to the displaced position, wherein said plastic materials of said flapper valve and said valve-actuating sleeve comprise plastics which can withstand operational conditions within a wellbore for the duration of run in and cementing operations.

17. The system of claim 16, wherein the connecting means is one or more shearable pins, each of said pins extending into a pin recess formed into the outer surface and near the upper end of the valve-actuating sleeve.

18. The system of claim 16, wherein the connecting means is a shoulder formed on the upper end of the valve-actuating sleeve and protruding radially outward, and a groove formed in the axial bore of the housing, said shoulder engaging said groove to attach the valve-actuating sleeve to the housing.

19. The system of claim 16, wherein the connecting means for attaching the valve-actuating sleeve to the housing is a groove formed in the axial bore of the housing and an aluminum shearing sleeve comprising: (i) a lower end being attached to the upper end of the valve-actuating sleeve, (ii) an upper end having a shoulder formed thereon, said shoulder protruding radially outward for engaging the groove of the housing to attach the valve-actuating sleeve to the housing, and (iii) a recess formed between the upper end and lower end of the shearing sleeve such that the thickness of the shearing sleeve is smallest at the recess.

20. The system of claim 16, wherein the tubular member is a casing liner or sub-sea casing.

21. The system of claim 16, wherein said hardened material is aluminum.

22. The system of claim 16, wherein said plastic material of said flapper valve comprises a cast nylon.

23. The system of claim 16, wherein said hardened plastic material of said sleeve comprises nylon-phenolic laminate.

24. The system of claim 16, wherein said plastic material of said sleeve comprises a cast nylon.

25. The system of claim 16, wherein said plastic material of said flapper valve comprises a nylon blend.

26. The system of claim 16, wherein said plastic material of said sleeve comprises a nylon blend.

27. The system of claim 16, wherein said plastic material of said flapper valve comprises type 6 nylon.

28. The system of claim 16, wherein said plastic material of said sleeve comprises type 6 nylon.

29. The system of claim 16, wherein said plastic material of said flapper valve comprises phenolic.

30. Float collar apparatus for regulating drilling fluid and cement flow through a tubular member being run in and cemented to a wellbore comprising:

a tubular housing having an external diameter less than the internal diameter of the tubular member and having axial bore therethrough, said housing being fabricated from hardened material, at least one flapper valve arranged within the housing having an open position where communication through the axial bore of the housing is uninterrupted by the flapper valve and a closed position where communication through the housing is interrupted by the flapper valve, said at least one flapper valve being fabricated from hardened plastic material, and a valve-actuating sleeve having an upper end and a lower end and being fabricated from hardened plastic material, said valve-actuating sleeve comprising: (i) an outer surface having a diameter less than or equal to the diameter of the axial bore of the housing; (ii) an inner surface having a seat integrally formed thereon, said seat having an axial bore therethrough with a diameter less than the diameter of the inner surface of the valve-actuating sleeve; and (iii) connecting means for attaching the valve-actuating sleeve to the housing, wherein the connecting means for attaching the valve-actuating sleeve to the housing is a shoulder formed on the upper end of the valve-actuating sleeve and protruding radially outward, and a groove formed in the axial bore of the housing, said shoulder engaging said groove to attach the valve-actuating sleeve to the housing.

31. Float collar apparatus for regulating drilling fluid and cement flow through a tubular member being run in and cemented to a wellbore comprising:

a tubular housing having an external diameter less than the internal diameter of the tubular member and having axial bore therethrough, said housing being fabricated from hardened material, at least one flapper valve arranged within the housing having an open position where communication through the axial bore of the housing is uninterrupted by the flapper valve and a closed position where communication through the housing is interrupted by the flapper valve, said at least one flapper valve being fabricated from hardened plastic material, and a valve-actuating sleeve having an upper end and a lower end and being fabricated from hardened plastic material, said valve-actuating sleeve comprising: (i) an outer surface having a diameter less than or equal to the diameter of the axial bore of the housing; (ii) an inner surface having a seat integrally formed thereon, said seat having an axial bore therethrough with a diameter less than the diameter of the inner surface of the valve-actuating sleeve; and (iii) connecting means for attaching the valve-actuating sleeve to the housing, wherein the connecting means for attaching the valve-actuating sleeve to the housing is a groove formed in the axial bore of the housing and a metal shearing sleeve comprising: (i) a lower end being attached to the upper end of the valve-actuating sleeve, (ii) an upper end having a shoulder formed thereon, said shoulder protruding radially outward for engaging the groove of the housing to attach the valve-actuating sleeve to the housing, and (iii) a recess formed between the upper end and lower end of the shearing sleeve such that the thickness of the shearing sleeve is smallest at the recess.

32. The apparatus of claim 31, wherein said metal shearing sleeve is fabricated from aluminum.

33. A system for regulating drilling fluid and cement flow through a tubular member being run in and cemented to a wellbore, said system comprising:

a housing being fixed within the tubular member and positioned near the lower end of the tubular member, said housing being fabricated from hardened material and having an axial bore therethrough to provide a conduit for drilling fluid and cement to flow downward through the tubular member and into the wellbore, at least one plastic flapper valve arranged within the housing and being fabricated from hardened plastic material, said at least one flapper valve having: (i) an open position where drilling fluid can flow through the axial bore of the housing, and (ii) a closed position where cement can flow downward from the tubular member into the wellbore but where cement cannot flow upward from the wellbore into the tubular member, a valve-actuating sleeve arranged within the housing, having an upper end, a lower end, and a drop ball seat integrally formed therein, and being fabricated from hardened plastic material, said valve-actuating sleeve being movable from a fixed position where connecting means prevents the valve-actuating sleeve from sliding axially downward such that the flapper valve is in the closed position, to a displaced position where the valve-actuating sleeve is displaced axially downward out of the housing such that the flapper valve moves to the closed position, a drop ball having a diameter greater than the diameter of the axial bore of the seat of the valve-actuating sleeve but less than or equal to the inner diameter of the valve-actuating sleeve, said drop ball being released into the housing and sealing with the seat, and means for increasing drilling fluid pressure above the drop ball to a predetermined level to move the valve-actuating sleeve from the fixed position to the displaced position, wherein the connecting means is a shoulder formed on the upper end of the valve-actuating sleeve and protruding radially outward, and a groove formed in the axial bore of the housing, said shoulder engaging said groove to attach the valve-actuating sleeve to the housing.

34. A system for regulating drilling fluid and cement flow through a tubular member being run in and cemented to a wellbore, said system comprising:

a housing being fixed within the tubular member and positioned near the lower end of the tubular member, said housing being fabricated from hardened material and having an axial bore therethrough to provide a conduit for drilling fluid and cement to flow downward through the tubular member and into the wellbore, at least one plastic flapper valve arranged within the housing and being fabricated from hardened plastic material, said at least one flapper valve having: (i) an open position where drilling fluid can flow through the axial bore of the housing, and (ii) a closed position where cement can flow downward from the tubular member into the wellbore but where cement cannot flow upward from the wellbore into the tubular member, a valve-actuating sleeve arranged within the housing, having an upper end, a lower end, and a drop ball seat integrally formed therein, and being fabricated from hardened plastic material, said valve-actuating sleeve being movable from a fixed position where connecting means prevents the valve-actuating sleeve from sliding axially downward such that the flapper valve is in the closed position, to a displaced position where the valve-actuating sleeve is displaced axially downward out of the housing such that the flapper valve moves to the closed position, a drop ball having a diameter greater than the diameter of the axial bore of the seat of the valve-actuating sleeve but less than or equal to the inner diameter of the valve-actuating sleeve, said drop ball being released into the housing and sealing with the seat, and means for increasing drilling fluid pressure above the drop ball to a predetermined level to move the valve-actuating sleeve from the fixed position to the displaced position, wherein the connecting means for attaching the valve-actuating sleeve to the housing is a groove formed in the axial bore of the housing and an aluminum shearing sleeve comprising: (i) a lower end being attached to the upper end of the valve-actuating sleeve, (ii) an upper end having a shoulder formed thereon, said shoulder protruding radially outward for engaging the groove of the housing to attach the valve-actuating sleeve to the housing, and (iii) a recess formed between the upper end and lower end of the shearing sleeve such that the thickness of the shearing sleeve is smallest at the recess.

35. A float collar for regulating drilling fluid and cement flow, comprising:

a tubular body having an interior;

a sleeve, positionable within said interior of said tubular body and releasably connectable to said tubular body; and a normally closed valve, comprising a plastic material which can withstand operational conditions within a wellbore for the duration of run in and cementing operations, wherein said valve is held open by said sleeve when said sleeve is positioned within and connected to said tubular body.

36. The float collar of claim 35, wherein said sleeve comprises a plastic material which can withstand operational conditions within a wellbore for the duration of run in and cementing operations.

37. The float collar of claim 36, wherein said plastic material comprises phenolic.

38. The float collar of claim 36, wherein said plastic material comprises phenolic-nylon laminate.

39. The float collar of claim 35, wherein said plastic material comprises phenolic.

40. A float collar for regulating drilling fluid and cement flow, comprising:

a tubular body having an interior;

a sleeve, comprising a plastic material which can withstand operational conditions within a wellbore for the duration of run in and cementing operations, positionable within said interior of said tubular body and releasably connectable to said tubular body; and a normally closed valve, wherein said valve is held open by said sleeve when said sleeve is positioned within and connected to said tubular body.

41. The float collar of claim 40, wherein said valve comprises a plastic material which can withstand operational conditions within a wellbore for the duration of run in and cementing operations.

42. The float collar of claim 41, wherein said plastic material comprises phenolic.

43. The float collar of claim 40, wherein said plastic material comprises phenolic.

44. The float collar of claim 40, wherein said plastic material comprises phenolic-nylon laminate.

* * * * *